United States Patent [19]

Beisel

[11] 4,440,081

[45] Apr. 3, 1984

[54] DAMPENING-INKING UNIT FOR OFFSET PRINTING MACHINES

[75] Inventor: Hermann Beisel, Walldorf, Fed. Rep. of Germany

[73] Assignee: Heidelberger Druckmaschinen, Heidelberg, Fed. Rep. of Germany

[21] Appl. No.: 442,901

[22] Filed: Nov. 19, 1982

[30] Foreign Application Priority Data

Nov. 21, 1981 [DE] Fed. Rep. of Germany ..... 3146223

[51] Int. Cl.[3] ..... B41F 7/36; B41F 7/40; B41L 25/14

[52] U.S. Cl. ..... 101/148; 101/350

[58] Field of Search ..... 101/148, 349, 350, 351, 101/352, 206, 207, 208, 209, 210

[56] References Cited

U.S. PATENT DOCUMENTS

| | | | |
|---|---|---|---|
| 3,673,959 | 7/1972 | Jezuit et al. | 101/148 |
| 3,769,909 | 11/1973 | Fugman et al. | 101/148 |
| 3,842,735 | 10/1974 | Southam et al. | 101/145 |
| 3,926,116 | 12/1975 | Wildeman | 101/148 |
| 4,237,785 | 12/1980 | Dahlgren | 101/148 |
| 4,351,236 | 9/1982 | Beisel et al. | 101/352 |

*Primary Examiner*—J. Reed Fisher

*Attorney, Agent, or Firm*—Herbert L. Lerner; Laurence A. Greenberg

[57] ABSTRACT

Dampening-inking unit for offset printing machines for forming and feeding an ink-water emulsion to a plate cylinder including a first and a second distributor roller, two inking rollers disposed between the first and second distributor rollers and connected to one another by an intermediate roller, the first distributor roller being a dampening-medium distributor roller in contact with one of the two inking rollers at a given contact location, means for driving the dampening-medium distributor roller, a fountain roller dipping into a dampening-medium tank, and a metering roller engageable with the fountain roller, the metering roller being also engageable with the one of the two inking rollers at a given contact location, the contact location of the metering roller and the one inking roller being upstream of the contact location of the dampening-medium distributor roller and the one inking roller, as viewed in direction of rotation of the one inking roller, the dampening-medium distributor roller having a rough chromium outer cylindrical surface for driving the first inking roller and for intensively working-in dampening medium applied to the one inking roller into an ink film disposed therebeneath on the one inking roller.

11 Claims, 3 Drawing Figures

DAMPENING-INKING UNIT FOR OFFSET PRINTING MACHINES

The invention relates to a dampening-inking unit for offset printing machines and, more particularly, to such a dampening-inking unit which forms and feeds an ink-water emulsion to a plate cylinder and has several inking rollers of which the first two inking rollers are disposed between a first and a second distributor roller and connected to one another by means of an intermediate roller. The dampening-inking unit further having a fountain roller in a dampening medium tank and a metering or proportioning roller.

A heretofore known dampening unit of this general type described in German Published Non-Prosecuted Application (DE-OS) No. 28 45 932 has a fountain roller and a metering roller which are driven by means of a separate drive at a peripheral speed lower than that of the plate cylinder. In this heretofore known construction, the metering roller cooperates with a first distributor roller which is driven at the same peripheral speed as that of the plate cylinder. Both cooperating rollers rotate in the same direction so that the dampening medium is transferred when the roller surfaces move in the opposite direction. The dampening-medium distributor roller, in turn, operates with a first inking roller, as viewed in rotary direction of the plate cylinder, which transfers the dampening medium to the plate. In the heretofore known construction of the dampening unit, an intermediate roller is provided between the first and the second inking rollers. Depending upon the application of the dampening unit, the dampening medium distributor roller can be associated with a storage roller.

This heretofore known construction has a disadvantage in that the dampening medium is fed and worked into the ink by the same dampening medium distributor roller so that reactions or repercussions upon the metering roller and fouling with ink at that location cannot be precluded. Furthermore, the opposite direction of movement of the roller surfaces of the metering roller and the distributor roller requires exact adjustment in order to avoid undesired wear of the roller surfaces.

Another heretofore known construction described in German Pat. (DE-PS) 678 543, although using fewer rollers in the dampening unit, nevertheless cannot thereby feed the dampening medium with such uniform distribution to the inking unit and to the plate cylinder that a print free of streaks and ghosts results. In this heretofore known construction, the metering roller cooperates directly with an inking roller; however, no provision is made for the preparation of an ink-water emulsion before initial contact of the dampening-medium film with the plate.

It is accordingly an object of the invention to provide a dampening-inking unit for offset printing machines with a minimum of technical expense which ensures an optimum feed of dampening medium to the printing plate without causing ghosting on the printed image due to the dampening unit.

With the foregoing and other objects in view, there is provided, in accordance with the invention, a dampening-inking unit for offset printing machines for forming and feeding an ink-water emulsion to a plate cylinder, includes a first and a second distributor roller, tow inking rollers disposed between the first and second distributor rollers and connected to one another by an intermediate roller, the first distributor roller being a dampening-medium distributor roller in contact with one of the two inking rollers at a given contact location, means for driving the dampening-medium distributor roller, a fountain roller dipping into a dampening-medium tank, and a metering roller engageable with the fountain roller, the metering roller being also engageable with the one of the two inking rollers at a given contact location, the contact location of the metering roller and the one inking roller being upstream of the contact location of the dampening-medium distributor roller and the one inking roller, as viewed in direction of rotation of the one inking roller, the dampening-medium distributor roller having a rough chromium outer cylindrical surface for driving the first inking roller and for intensively working-in dampening medium applied to the one inking roller into an ink film disposed therebeneath on the one inking roller.

In accordance with another feature of the invention, the plate cylinder is driven at a high peripheral speed, and the means for driving the dampening-medium distributor roller does so at the peripheral speed of the plate cylinder.

In accordance with an alternate feature of the invention, the means for driving the dampening-medium distributor roller does so at a higher peripheral speed than that of the plate cylinder, and reduction transmission means connecting the dampening-medium distributor roller and the one inking roller drives the one inking roller at the peripheral speed of the plate cylinder.

In accordance with a further feature of the invention, the dampening-medium distributor roller and the fountain roller are fixed in position, and including means for pivoting and adjusting the one inking roller with respect to the fixed dampening-medium distributor roller and means for pivoting and adjusting the metering roller with respect to the fixed fountain roller, the metering roller being initially pivotable into contact with the one inking roller and being further pivotable so as to bring the one inking roller into contact with the plate cylinder.

In accordance with an additional feature of the invention, the fountain roller has an outer cylindrical surface formed of elastic material, the cylindrical surface being slightly convex in longitudinal direction thereof.

In accordance with still another feature of the invention, the reduction transmission means include intermeshing gears carried respectively by the dampening-medium distributor roller and the inking roller.

In accordance with a concomitant feature of the invention, the dampening-medium distributor roller has a smaller diameter than that of the dampening-medium distributor roller and the gear carried by one ink roller has a greater diameter than that of the one ink roller. Other features which are considered as characteristic for the invention are set forth in the appended claims.

Although the invention is illustrated and described herein as embodied in a dampening-inking unit for offset printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
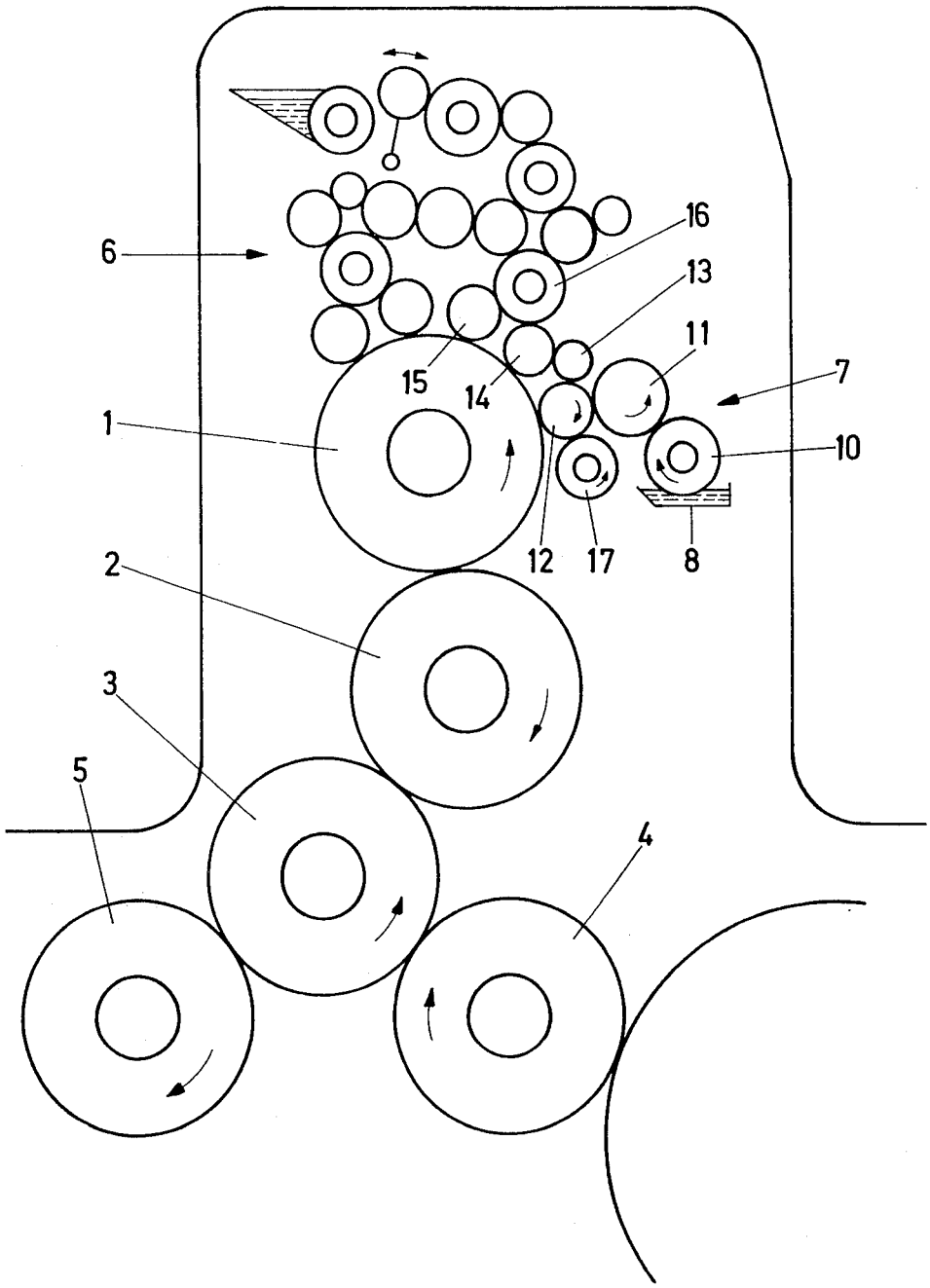
FIG. 1 is a diagrammatic side elevational view of an offset printing unit incorporating the dampening-inking unit according to the invention.

Referring now to the drawings and first, particularly, to FIG. 1 thereof, there are shown with an inking unit of an offset printing machine, a plate cylinder 1, a rubber-covered cylinder 2 and a printing cylinder 3 cooperating in a conventional manner. Sheets which are being printed are fed to the printing cylinder 3 by a transfer drum 4 and are removed by another transfer drum 5. The respective sheets are printed between the rubber-covered cylinder 2 and the printing cylinder 3. The plate cylinder 1 is inked in a conventional manner by an inking unit 6. Viewed in direction of rotation of the plate cylinder 1, a dampening unit 7 is provided forward or upstream of the inking unit 6. Details of the dampening unit 7 are described hereinbelow.

Figure 2:
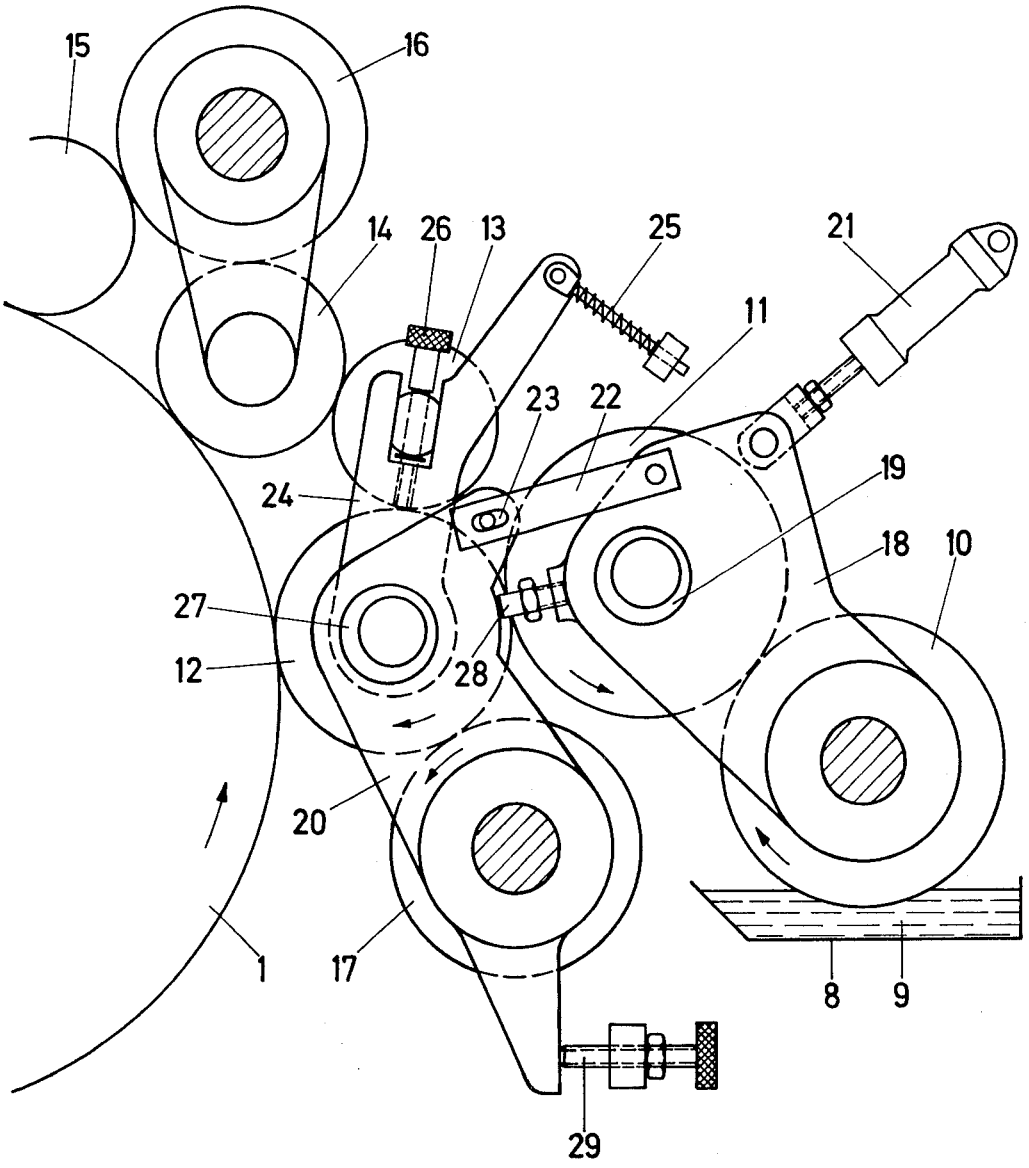
FIG. 2 is an enlarged fragmentary view of FIG. 1 showing the dampening unit according to the invention in greater detail.

Dampening medium 9 is contained in a dampening-medium tank 8 wherein a fountain roller 10 rotates and is wetted by the dampening medium 9, as shown more clearly in FIG. 2. The fountain roller 10 is fixedly mounted, in a conventional manner in non-illustrated side frames of the printing machine. The surface of the fountain roller 10 is elastic and may, for example, be formed of rubber. A metering or proportioning roller 11 cooperates with the fountain roller 10. The metering roller 11 is provided with a smooth chromium surface and can be pivoted about the fountain roller 10, for example by means of a lever 18. The metering roller 11 is mounted in such a manner that the spacing between both rollers 10 and 11 can be adjusted by means of eccentric bushings 19 so that the thickness of the dampening-medium film on the metering roller 11 is variable. The fountain roller 10 and the metering roller 11 are coupled by non-illustrated spur gears and are driven by a separate drive at a peripheral speed lower than that of the plate cylinder 1. The peripheral speed of both rollers 10 and 11 are freely controllable by means of the drive, the respectively set speed being kept constant.

The metering roller 11 cooperates with the first inking roller 12, as viewed in direction of rotation of the plate cylinder 1. The first inking roller 12 is, in turn, connected to a second inking roller 14 by means of a non-driven intermediate roller 13. The second inking roller 14 as well as a next inking roller 15 are in contact with an ink distributor roller 16.

A dampening-medium distributor roller 17 which is fixedly mounted in the non-illustrated machine side frames and is driven at the peripheral speed of the plate cylinder 1 is associated with the first inking roller 12 following or downstream of the contact point of the first inking roller 12 with the metering roller 11, as viewed in direction of rotation of the first inking roller 12. Since in this embodiment of the invention, the rollers 12 to 17 all rotate at the peripheral speed of the plate cylinder 1, there exists between the inking roller 12 and the metering roller 11 a speed difference by means of which the quantity of the dampening medium fed can be varied.

The dampening-medium distributor roller 17 is provided with a roughened chromium, outer cylindrical surface and supports the driven of the inking roller 12 which is provided with an elastic outer cylindrical surface. Furthermore, the dampening-medium distributor roller 17 with its rough chromium surface works the dampening-medium film fed from the metering roller 11 intensively into the ink film already present on the outer cylindrical surface of the inking roller 12, with the result that a favorable ink-water emulsion is attained.

The inking roller 12 is pivotable about the dampening-medium distributor roller 17 by means of levers 20 which are provided on both sides thereof so that the inking roller 12 can be lifted off the surface of the plate cylinder 1. By means of a pneumatic cylinder 21 and a connecting rod 22, the metering roller 11 is initially lifted off the inking roller 12 so that the feed of dampening medium is interrupted. Then, delayed by a pin and slot connection 23, the inking roller 12 is lifted off the plate cylinder 1. To bring the dampening unit into engagement, the metering roller 11 is initially brought up against the inking roller 12 and, then, the inking roller 12 is brought into contact with the plate cylinder 1 by the metering roller 11. The intermediate roller 13 is brought into engagement with the inking roller 14 by means of a lever 24 and a pressure spring 25 and is adjusted with respect to the inking roller 12 by means of an adjusting screw 26, the intermediate roller 13, when engaged, being in resilient or spring contact with the inking roller 14. The inking roller 12 can be adjusted with respect to the dampening-medium distributor roller 17 by means of eccentric bushings 27 and can be adjusted with respect to the metering roller 11 by means of adjusting screws 28. By means of a stop screw 29, the inking roller 12 can be adjusted with respect to the plate cylinder 1.

The outer cylindrical surface of the fountain roller 10 is formed of elastic material and is slightly convex in longitudinal direction thereof so that a uniform distribution of the dampening medium is assured over the length of the roller 10.

The rough chromium surface of the dampening-medium distributor roller 17 associated with the inking roller 12 prevents the formation of a water wedge between itself and the inking roller 12. The lateral reciprocating motion of the dampening-medium distributor roller 17 and the rolling motion improve the working-in of the dampening medium into the ink film and, as can be demonstrated, prevent ghosting or patterning in the printed image.

Figure 3:
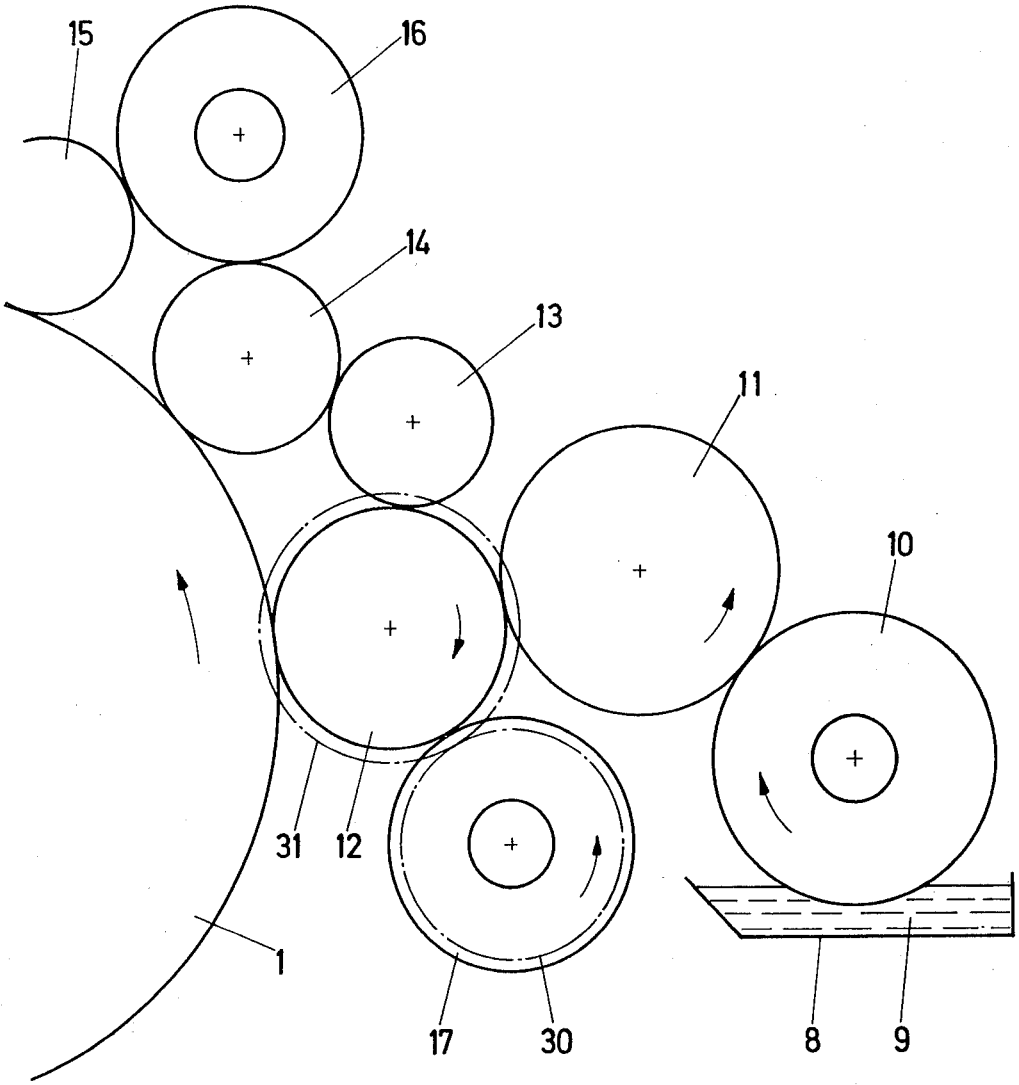
FIG. 3 is a view similar to that of FIG. 2 but only showing the rollers of the dampening unit of another embodiment of the invention.

The only difference between the diagrammatic view of the dampening unit embodiment shown in FIG. 3 and that according to FIG. 2 is that the dampening-medium distributor roller 17, the drive of which is not shown, bears a spur gear 30 of smaller diameter which meshes with a spur gear 31 disposed on the inking roller 12, the diameter of the spur gear 31 being greater than the diameter of the inking roller 12. The dampening-medium distributor roller 17 is driven faster by an amount corresponding to the spur gear reduction with the result that the inking roller 12 rotates at the peripheral speed of the plate cylinder 1. The speed difference between the outer cylindrical surfaces of the inking roller 12 and the dampening-medium distributor roller 17 further improves the working-in of the dampening medium into the ink film.

The foregoing is a description corresponding to German Application No. P 31 46 223.5, filed Nov. 21, 1982, the International priority of which is being claimed for the instant application, and which is hereby made part of this application. Any discrepancies between the foregoing specification and the aforementioned corresponding German application are to be resolved in favor of the latter.

I claim:

1. Dampening-inking unit for offset printing machines for forming and feeding an ink-water emulsion to a plate cylinder, comprising a first and a second distributor roller, two inking rollers disposed between said first and second distributor rollers and connected to one another by an intermediate roller, said first distributor roller being a dampening-medium distributor roller in contact with one of said two inking rollers at a given contact location, means for driving said dampening-medium distributor roller, a fountain roller dipping into a dampening-medium tank, and a metering roller engageable with the fountain roller, said metering roller being also engageable with said one of said two inking rollers at a given contact location, said contact location of said metering roller and said one inking roller being upstream of said contact location of said dampening-medium distributor roller and said one inking roller, as viewed in direction of rotation of said one inking roller, said dampening-medium distributor roller having a rough chromium outer cylindrical surface for driving said first inking roller and for intensively working-in dampening medium applied to said one inking roller into an ink film disposed therebeneath on said one inking roller.

2. Dampening-inking unit for offset printing machines for forming and feeding an ink-water emulsion to a plate cylinder driven at a given peripheral speed, comprising a first and a second distributor roller, two inking rollers disposed between said first and second distributor rollers and connected to one another by an intermediate roller, said first distributor roller being a dampening-medium distributor roller in contact with one of said two inking rollers at a given contact location, means for driving said dampening-medium distributor roller at the peripheral speed of the plate cylinder, a fountain roller dipping into a dampening-medium tank, and a metering roller engageable with the fountain roller, said metering roller being also engageable with said one of said two inking rollers at a given contact location, said contact location of said metering roller and said one inking roller being upstream of said contact location of said dampening medium distributor roller and said one inking roller, as viewed in direction of rotation of said one inking roller, said dampening-medium distributor roller having a rough chromium outer cylindrical surface for driving said first inking roller and for intensively working-in dampening medium applied to said one inking roller into an ink film disposed therebeneath on said one inking roller.

3. Dampening-inking unit for offset printing machines for forming and feeding an ink-water emulsion to a plate cylinder driven at a given peripheral speed, comprising a first and a second distributor roller, two inking rollers disposed between said first and second distributor rollers and connected to one another by an intermediate roller, said first distributor roller being a dampening-medium distributor roller in contact with one of said two inking rollers at a given contact location, means for driving said dampening-medium distributor roller at a higher peripheral speed than that of the plate cylinder, reduction transmission means connecting said dampening-medium distributor roller and said one inking roller for driving said one inking roller at the peripheral speed of the plate cylinder, a fountain roller dipping into a dampening-medium tank, and a metering roller engageable with the fountain roller, said metering roller being also engageable with said one inking roller at a given location, said contact location of said metering roller and said one inking roller being upstream of said contact location of said dampening medium distributor roller and said one inking roller as viewed in direction of rotation of said one inking roller, said dampening-medium distributor roller having a rough chromium outer cylindrical surface for driving said first inking roller and for intensively working-in dampening medium applied to said one inking roller into an ink film disposed therebeneath on said one inking roller.

4. Dampening-inking unit according to claim 1 wherein said dampening medium distributor roller and said fountain roller are fixed in position, and including means for pivoting and adjusting said one inking roller with respect to said fixed dampening-medium distributor roller and means for pivoting and adjusting said metering roller with respect to said fixed fountain roller, said metering roller being initially pivotable into contact with said one inking roller and being further pivotable so as to bring said one inking roller into contact with the plate cylinder.

5. Dampening-inking unit according to claim 2 wherein said dampening-medium distributor roller and said fountain roller are fixed in position, and including means for pivoting and adjusting said one inking roller with respect to said fixed dampening-medium distributor roller, and means for pivoting and adjusting said metering roller with respect to said fixed fountain roller, said metering roller being initially pivotable into contact with said one inking roller and being further pivotable so as to bring said one inking roller into contact with the plate cylinder.

6. Dampening-inking unit according to claim 3 wherein said dampening-medium distributor roller and said fountain roller are fixed in position, and including means for pivoting and adjusting said one inking roller with respect to said fixed dampening-medium distributor roller, and means for pivoting and adjusting said metering roller with respect to said fixed fountain roller, said metering roller being initially pivotable into contact with said one inking roller and being further pivotable so as to bring said one inking roller into contact with the plate cylinder.

7. Dampening-inking unit according to claim 1 wherein said fountain roller has an outer cylindrical surface formed of elastic material, said cylindrical surface being slightly convex in longitudinal direction thereof.

8. Dampening-inking unit according to claim 2 wherein said fountain roller has an outer cylindrical surface formed of elastic material, said cylindrical surface being slightly convex in longitudinal direction thereof.

9. Dampening-inking unit according to claim 3 wherein said fountain roller has an outer cylindrical surface formed of elastic material, said cylindrical surface being slightly convex in longitudinal direction thereof.

10. Dampening-inking unit according to claim 3 wherein said reduction transmission means comprise intermeshing gears carried respectively by said dampening-medium distributor roller and said one inking roller.

11. Dampening-inking unit according to claim 10 wherein the gear carried by said dampening-medium distributor roller has a smaller diameter than that of said dampening-medium distributor roller and said gear carried by said one inking roller has a greater diameter than that of said one inking roller.

* * * * *